US007622011B2

(12) United States Patent
Inoue et al.

(10) Patent No.: US 7,622,011 B2
(45) Date of Patent: Nov. 24, 2009

(54) SPHERICAL PARTICLES OF FE BASE METALLIC GLASS ALLOY, FE BASE SINTERED ALLOY SOFT MAGNETIC MATERIAL IN BULK FORM PRODUCED BY SINTERING THE SAME, AND METHOD FOR THEIR PRODUCTION

(75) Inventors: Akihisa Inoue, Sendai (JP); Baolong Shen, Sendai (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 482 days.

(21) Appl. No.: 10/540,527

(22) PCT Filed: Dec. 24, 2003

(86) PCT No.: PCT/JP03/16542

§ 371 (c)(1),
(2), (4) Date: Apr. 13, 2006

(87) PCT Pub. No.: WO2004/059020

PCT Pub. Date: Jul. 15, 2004

(65) Prior Publication Data

US 2006/0254386 A1 Nov. 16, 2006

(30) Foreign Application Priority Data

Dec. 25, 2002 (JP) ..... 2002-374553

(51) Int. Cl.
*H01F 1/153* (2006.01)

(52) U.S. Cl. ..... 148/304; 148/104; 148/403; 75/230; 75/246

(58) Field of Classification Search ..... None
See application file for complete search history.

(56) References Cited

U.S. PATENT DOCUMENTS 6,594,157 B2 * 7/2003 Yoshida et al. ..... 363/14
7,132,019 B2 * 11/2006 Koshiba et al. ..... 148/304

FOREIGN PATENT DOCUMENTS

| | | |
|---|---|---|
| JP | 8-333660 | 12/1996 |
| JP | 8-337839 | 12/1996 |
| JP | 9-320827 | 12/1997 |
| JP | 10-92619 | 4/1998 |
| JP | 11-71647 | 3/1999 |

(Continued)

OTHER PUBLICATIONS

Baolong Shen et al., Bulk Glassy Fe-Ga-P-C-B-Si Alloys with High Glass-Forming Ability, High Saturation Magnetization and Good Soft Magnetic Properties, Materials Transactions, May 2002, pp. 1235-1239, vol. 43 No. 5, The Japan Institute of Metals, Sendai, Japan.

(Continued)

*Primary Examiner*—John P. Sheehan
(74) *Attorney, Agent, or Firm*—Westerman, Hattori, Daniels & Adrian, LLP

(57) ABSTRACT

Disclosed is a Fe—Ga—P—C—B—Si based metallic glass alloy particle prepared by a gas atomizing process, which has an approximately complete spherical shape, a relatively large particle size and a high crystallization temperature (Tx). The plurality of particles may be subjected to a spark plasma sintering process at the crystallization temperature or less under a compression pressure of 200 MPa or more, to provide a bulk Fe-based sintered metal soft magnetic material of metallic glass, which has a high density, a single phase structure of metallic glass in an as-sintered state, excellent soft magnetic characteristics applicable to a core of a magnetic head, a transformer or a motor, and a high specific resistance.

4 Claims, 8 Drawing Sheets

FOREIGN PATENT DOCUMENTS

| | | |
|---|---|---|
| JP | 11-71648 | 3/1999 |
| JP | 11-73608 | 3/1999 |
| JP | 11-73609 | 3/1999 |
| JP | 11-74109 | 3/1999 |
| JP | 11-74111 | 3/1999 |
| JP | 2000-345308 | 12/2000 |
| JP | 2001-152301 | 6/2001 |
| JP | 2001-316782 | 11/2001 |
| JP | 2001-338808 | 12/2001 |
| JP | 2002-226956 | 8/2002 |

OTHER PUBLICATIONS

Baolong Shen et al., "Consolidation of Fe-Co-Ga-P-C-B Glassy Powders by . . . " Journal of the Japan Society of Powder and Powder Metallurgy vol. 48, No. 9, pp. 858-862 Received Jul. 16, 2001, partial translation.

Baolong Shen et al., "Preparation of $Fe_{65}Co_{10}Ga_5P_{12}C_4B_4$ Bulk . . . " *Materials Transactions*, vol. 43, No. 8 (2002) pp. 1961 to 1965.

Shen, B. et al., "Preparation of Fe66 Co10 Ga6P12 C4 B4 Glassy Metal Magnetic Cores by Spark Plasma Sintering" Abstracts of Autumn Meeting of Japan Society of Powder and Powder Metallurgy, 2002, p. 196.

* cited by examiner

SPHERICAL PARTICLES OF FE BASE METALLIC GLASS ALLOY, FE BASE SINTERED ALLOY SOFT MAGNETIC MATERIAL IN BULK FORM PRODUCED BY SINTERING THE SAME, AND METHOD FOR THEIR PRODUCTION

TECHNICAL FIELD

The present invention relates to spherical particles of Fe-based metallic glass alloy, a bulk Fe-based sintered alloy soft magnetic material of metallic glass, prepared by sintering the spherical particles, which has excellent magnetic characteristics applicable to a core of a magnetic head, a transformer or a motor, and methods for their production

BACKGROUND ART

A conventional soft magnetic material applicable to a core of a magnetic head, a transformer, a motor, etc., includes a Fe—Si alloy, a Fe—Si—Al alloy (Sendust), a Ni—Fe alloy (Permalloy), and a Fe-based or Co-based amorphous alloy material. When a soft magnetic material is applied to a DC motor core etc., it is generally effective to form the soft magnetic material in a high-density bulk shape. Contrary to this need, the conventional amorphous alloy material prepared by quenching molten metal has been able to be formed only in a limited shape, such as thin strip, wire, powder or thin film.

In the circumstances, a method comprising mechanically crushing the amorphous alloy thin strip, sintering the obtained alloy powder, and solidifying/forming the sintered alloy in a bulk shape has been developed. However, this method has a problem about difficulties in obtaining a high-density sintered body due to the need for performing the sintering process at a relatively low temperature to prevent the alloy powder from being crystallized during the sintering process.

The dream of forming an amorphous alloy in a bulk shape has been realized by a "metallic glass alloy". Specifically, in the 1980s, an alloy having a high glass forming ability was found in Pd—Si—Cu alloys. Further, since 1990, alloys having an extremely high glass forming ability were found. Generally, in an "amorphous alloy", crystallization is developed during heating before reaching a glass transition point, and no glass transition can be observed on an experimental basis. In contrast, in the "metallic glass alloy", a clear glass transition is observed during heating, and a temperature interval of a supercooled liquid region before a crystallization temperature increases up to several ten K. This property has opened the way for forming a bulk amorphous alloy by a casting method using a cupper die with a low cooling rate. The reason why such an amorphous alloy is particularly called "metallic glass" is that it is a stable amorphous material like an oxide glass, and subject to plastic deformation (viscous flow) at a high temperature, even though it is metal.

The "metallic glass alloy" has a high glass forming ability, or a characteristic capable of being solidified from the molten alloy in a supercooled liquid state though a casting process using a copper die or the like to produce a metal cast body consisting of a glass phase and having a larger size, the so-called "bulk shape". The "metallic glass alloy" also has a characteristic capable of being heated to a supercooled liquid state and subjected to a plastic working. Essentially differently from the "amorphous alloy", such as conventional amorphous thin strip or fiber, devoid of these characteristics, the "metallic glass alloy" has significantly high usefulness.

The inventors previously developed a Fe-based [Fe—Al—Ga—P—C—B based, Fe—(Co, Ni)—(Nb, Zr, Mo, Cr, V, W, Ta, Hf, Ti)—Ga—P—C—B based or Fe—(Co, Ni)—Ga—(P, C, B) based] soft magnetic metallic glass alloy containing Ga as an essential element (see the following Patent Publications 1 to 5). Further, a Fe-based [Fe—Al—P—C—B—(Cr, Mo, V) based] soft magnetic metallic glass alloy containing no Ga was developed (see the following Patent Publication 6).

Recently, a metallic glass sintered body prepared by sintering a metallic glass alloy powder having a supercooled liquid region has been proposed. This metallic glass sintered body is a bulk sintered body having no restraint in shape, and thereby can be suitably used in a core of a magnetic head, a transformer or a motor (see the following Patent Publications 7 to 10).

The inventors previously filed a patent application covering an invention on a Fe-based soft magnetic metallic glass sintered body prepared by spark-sintering particles having a primary component of a Fe-based [Fe—(Ti, Zr, Hf, V, Nb, Ta, Mo, W)—B based, Fe—Al—Ga—P—C—B—Si based, Fe—Co—Ni—(Zr, Nb)—B based, etc.] amorphous alloy, and a method for its production through a spark plasma sintering process (see the following Patent Publications 11 to 13). The inventors also filed a patent application covering an invention on a Fe-based soft magnetic metallic glass sintered body prepared by sintering plate-shaped particles of Fe-based (Fe—Al—Ga—P—C—B—Si based, etc.) amorphous alloy in a temperature range of 693 to 713 K (see the following Patent Publication 14). Further, the inventors reported a Fe-based soft magnetic metallic glass sintered body prepared by spark-discharging particles obtained through a gas atomizing process, which have a particle size of 10 to 30 μm, and a primary component of Fe—Co—Ga—P—C—B based amorphous alloy (see the following Non-Patent Publications 1 to 3).

Patent Publication 1: Japanese Patent Laid-Open Publication No. 08-333660

Patent Publication 2: Japanese Patent Laid-Open Publication No. 09-320827

Patent Publication 3: Japanese Patent Laid-Open Publication No. 11-071647

Patent Publication 4: Japanese Patent Laid-Open Publication No. 2001-152301

Patent Publication 5: Japanese Patent Laid-Open Publication No. 2001-316782

Patent Publication 6: Japanese Patent Laid-Open Publication No. 2002-226956

Patent Publication 7: Japanese Patent Laid-Open Publication No. 11-073608

Patent Publication 8: Japanese Patent Laid-Open Publication No. 11-073609

Patent Publication 9: Japanese Patent Laid-Open Publication No. 11-074109

Patent Publication 10: Japanese Patent Laid-Open Publication No. 11-074111

Patent Publication 11: Japanese Patent Laid-Open Publication No. 08-337839

Patent Publication 12: Japanese Patent Laid-Open Publication No. 10-092619

Patent Publication 13: Japanese Patent Laid-Open Publication No. 11-071648

Patent Publication 14: Japanese Patent Laid-Open Publication No. 2000-345308

Non-Patent Publication 1: Baolong Shen et al., "Bulk Formation by Spark-Plasma Sintering of Fe—Co—Ga—P—

C—B Glass Alloy Powder and Magnetic Characteristics thereof", Powder and Powder Metallurgy, Vol. 48, No. 9, September 2001, pp. 858-862

Non-Patent Publication 2: Baolong Shen et al., "Preparation of $Fe_{65}Co_{10}Ga_5P_{12}C_4B_4$ Glassy Alloy with Good Soft Magnetic Properties by Spark-Plasma Sintering of Glassy Power", Materials Transactions, Vol. 43, No. 8, p. 1961-1965 (2002)

Non-Patent Publication 2: Baolong Shen et al., "Preparation of $Fe_{65}Co_{10}Ga_5P_{12}C_4B_4$ Metallic Glass Magnetic Core by Spark-Plasma Sintering", "Journal of Japan Society of Powder and Powder Metallurgy", November 2002, p. 196

DISCLOSURE OF INVENTION

The aforementioned method comprising mechanically crushing an amorphous alloy thin strip, sintering the obtained alloy powder, and solidifying/forming the sintered alloy in a bulk shape is required to perform the sintering process at a relatively low temperature to prevent the alloy powder from being crystallized during the sintering process. Moreover, the mechanically crushed powder has a poor quality. Thus, an obtained sintered body has a low density, and poor in soft magnetic characteristics, such as magnetic permeability and coercive force.

In the conventional sintered alloys disclosed in the Patent Publications 11 to 13, a powder obtained in a powdering process for crushing a body prepared in various shapes, such as bulk, ribbon or wire shape, by subjecting a molten alloy having a given composition to a casting process, and a quenching process, such as a single-roll or twin-roll process, or a powder prepared by a high-pressure-gas atomizing process, is used as a raw material.

This raw alloy is a metallic glass wherein while a temperature interval of a supercooled liquid region ($\Delta Tx$) as one of indexes for evaluating a glass forming ability is 20 K or more, a reduced glass transition temperature (Tg/Tl) (wherein Tg is a glass transition temperature, and Tl is a liquidus temperature) as the other index is less than 0.59. Thus, the raw alloy is insufficient in glass forming ability. This causes difficulties in preparing a spherical metallic glass alloy fine particle directly by a high-pressure-gas atomizing process.

In the liquid quenching process using a single roll or twin rolls, molten metallic glass alloy is ejected from a nozzle directly onto a copper roll rotated at a high speed, and heat of the molten alloy is drawn by the copper roll excellent in thermal conductivity. Thus, even if the alloy has a low glass forming ability, a ribbon-shaped amorphous alloy can be prepared therefrom. In the high-pressure-gas atomizing process, a high-speed gas flow is sprayed to molten metallic glass alloy ejected from a nozzle to form droplets of the metallic glass alloy, and the formed droplets are rapidly solidified to prepare powdered particles. In this process, a cooling medium is ambient gas, and thereby a sufficient heat absorption capacity cannot be ensured therein. Thus, if a raw alloy has a low glass forming ability, it becomes increasingly difficult to produce a powdered particle with a structure primarily comprising an amorphous phase, as it is attempted to obtain a larger particle size.

With this point in view, the inventors produced plate-shaped particles by crushing a metallic glass alloy thin strip prepared by a liquid quenching process, and sorting the obtained particles, as disclosed in the Patent Publication 14. However, the plate-shaped particles have a low fluidity, and a high-density green compact cannot be obtained therefrom. This makes it difficult to prepare a sintered body having a high density (relative density of 99% or more), and an obtained sintered body is poor in soft magnetic characteristics, such as magnetic permeability and coercive force.

As disclosed in the Non-Patent Publication 1, a single glass phase sintered body prepared at a sintering temperature of 723 K has a relative density of about 96%, and a coercive force of 115 A/m, which are fairly greater than those of a rapidly-quenched ribbon material having the same composition. Further, as disclosed in the Non-Patent Publications 2 and 3, a single glass phase sintered body prepared at a sintering temperature of 723 K exhibits excellent soft magnetic characteristics, such as a saturation magnetization of 1.2 T, a coercive force of 12 A/m, and a maximum permeability of 6000. However, these Fe-based metallic glasses contain costly Co in an amount of 10 atomic %. Moreover, while a sintered body having a higher density can be obtained as a sintering temperature is increased, a crystal phase to be precipitated in conjunction with the increased sintering temperature will undesirably cause deterioration in soft magnetic characteristics. Thus, it is extremely difficult to obtain a sintered body having both a high density and magnetic characteristics equivalent or superior to those of the rapidly-quenched ribbon material having the same composition.

In view of the above circumstances, it is an object of the present invention to obtain a metallic glass alloy particle having excellent soft magnetic characteristics and a high crystallization temperature, in a reduced content of Co or without using Co.

It is another object of the present invention to obtain a bulk Fe-based sintered alloy soft magnetic material of metallic glass, prepared by sintering the plurality of metallic glass alloy particles, which has soft magnetic characteristics superior to those of $Fe_{65}Co_{10}Ga_5P_{12}C_4B_4$.

In order to achieve the above objects, the present invention is directed to subject a given alloy composition having an extremely high amorphous-alloy forming ability and excellent soft magnetic characteristics to an atomizing process having a low cooling rate so as to obtain a spherical metallic glass alloy particle with a large particle size, and to subject the plurality of spherical metallic glass alloy particles to a spark plasma sintering process under a high compression pressure so as to prepare a high-density sintered body consisting of a metallic glass phase having a relative density of 99.0% or more, or provide a bulk Fe-based sintered alloy soft magnetic material of metallic glass having extremely excellent soft magnetic characteristics.

A metallic glass for use in producing an amorphous soft magnetic alloy sintered body of the present invention has a temperature interval of a supercooled liquid region ($\Delta Tx$) of 25 K or more, preferably 40 K or more, as expressed by the following formula: $\Delta Tx = Tx - Tg$ (wherein Tx is a crystallization (onset) temperature, and Tg is a glass transition temperature), and a reduced glass transition temperature of 0.59 or more, as expressed by the following formula: Tg/Tl (wherein Tg is a glass transition temperature, and Tl is a liquidus temperature). These characteristics make it possible to readily produce an alloy particle consisting of a single phase of metallic glass and having an approximately complete spherical shape, through a high-pressure-gas atomizing process.

Specifically, according to a first aspect of the present invention, there is provided a spherical particle of metallic glass alloy prepared by an atomizing process, which has a particle size of 30 to 125 μm, and a composition consisting of, by atomic %, 0.5 to 10% of Ga, 7 to 15% of P, 3 to 7% of C, 3 to 7% of B and 1 to 7% of Si, with the remainder being Fe.

According to a second aspect of the present invention, there is provided a bulk Fe-based sintered alloy soft magnetic material of metallic glass, which consists of a high-density metallic glass phase sintered body with a relative density of 99.0% or more, prepared by sintering the plurality of spherical particles of metallic glass alloy set forth in the first aspect of the present invention, and has a magnetic permeability of 3900 (μmax) or more and a coercive force (Hc) of 19 (A/m) or less in an as-sintered state. The metallic glass has a temperature interval of a supercooled liquid region (ΔTx) of 25 K or more, as expressed by the following formula: ΔTx=Tx−Tg (wherein Tx is a crystallization temperature, and Tg is a glass transition temperature), and a reduced glass transition temperature of 0.59 or more, as expressed by the following formula: Tg/Tl (wherein Tg is a glass transition temperature, and Tl is a liquidus temperature).

The amorphous soft magnetic alloy can have a temperature interval of a supercooled liquid region (ΔTx) of 25 K or more by setting a composition ratio of Ga in the range of 0.5 to 10 atomic % in the composition of the spherical metallic glass alloy particle set forth in the first aspect of the present invention. Further, the mixing enthalpy of Ga—Fe is negative, and Ga has a larger atomic radius than that of Fe. Thus, Ga can be used with P, C and/or B having a smaller atomic radius than that of Fe to provide a hard-to-crystallize state and a thermally stabilized state in the amorphous structure. Ga can also increase the Curie temperature of the amorphous soft magnetic alloy to provide enhanced thermal stability in the magnetic characteristics. If the composition ratio of Ga becomes greater than 10 atomic %, the content of Fe will be relatively reduced to cause deterioration in saturation magnetization, and disappearance of the temperature interval of the supercooled liquid region (ΔTx). Preferably, the composition ratio of Ga is set in the range of 2 to 8 atomic %.

Fe is an element bearing a central role for magnetism, or one of essential elements of the amorphous soft magnetic alloy of the present invention as well as Ge.

P has a particularly high amorphous-material forming ability. Thus, in addition to C, B and Si, the composition can essentially include P to allow the structure to be entirely formed as an amorphous phase, and to facilitate forming the temperature interval of the supercooled liquid region (ΔTx). The composition ratio of C is set in the range of 3 to 7 atomic %, and the composition ratio of B is set in the range of 3 to 7 atomic %. Further, the composition ratio of Si is set in the range of 1 to 7 atomic %.

Each composition ratio of P and Si can be set in the above range to provide an increased temperature interval of the supercooled liquid region (ΔTx) so as to increase the size of a bulk alloy to be formed as a single amorphous phase. If the composition ratio of Si becomes greater than 7 atomic %, the content of Si will be excessively increased to cause the risk of vanishing the temperature interval of the supercooled liquid region (ΔTx).

According to a third aspect of the present invention, there is provided a bulk Fe-based sintered alloy soft magnetic material of metallic glass, prepared by subjecting the bulk Fe-based sintered alloy soft magnetic material set forth in the second aspect of the present invention to a heat treatment in a temperature range of 573 to 723 K, which has a magnetic permeability of 7000 (μmax) or more and a coercive force (Hc) of 12 (A/m) or less.

According to a fourth aspect of the present invention, there is provided a method of producing a spherical particle of metallic glass alloy, which comprises melting an alloy having a composition consisting of, by atomic %, 0.5 to 10% of Ga, 7 to 15% of P, 3 to 7% of C, 3 to 7% of B and 1 to 7% of Si, with the remainder being Fe, dropping or ejecting the molten alloy from a nozzle, and spraying high-speed gas to droplets of the molten alloy to rapidly solidify the droplets so as to obtain an alloy particle having an amorphous phase and a maximum particle size of 30 to 125 μm.

According to a fifth aspect of the present invention, there is provided a method of producing the Fe-based sintered alloy soft magnetic material set forth in the second aspect of the present invention, which comprises preparing a plurality of spherical particles of metallic glass alloy having a particle size of 30 to 125 μm by the method set forth in the fourth aspect of the present invention, and sintering the spherical particles by a spark plasma sintering process under the conditions that: a heating rate is set at 40 K/min or more; a sintering temperature (T) is set in a temperature range satisfying a relationship of T≦Tx, wherein Tx is a crystallization (onset) temperature; and a compression pressure is set at 200 MPa or more.

According to a sixth aspect of the present invention, there is provided a method of producing the bulk Fe-based sintered alloy soft magnetic material of metallic glass set forth in the third aspect of the present invention, which comprises preparing a Fe-based sintered alloy soft magnetic material by the method set forth in the fifth aspect of the present invention, and subjecting the Fe-based sintered alloy soft magnetic material to a heat treatment in a temperature range of 573 to 723 K.

The Fe-based sintered alloy soft magnetic material of the present invention has a soft magnetism at room temperature, and exhibits a high saturation magnetization of 1.3 to 1.4 T. Further, the Fe-based sintered alloy soft magnetic material has a Curie temperature of 600 K or more, and thereby has a thermal stability in the magnetic characteristics. This sintered body exhibits a high specific resistance value of 1.6 μΩm or more.

Each value of the above characteristics was measured from a sample prepared by sintering the spherical particles in a disc shape having a diameter of 20 mm and a thickness of 5 mm using a spark plasma sintering apparatus to form a Fe-based alloy soft magnetic material, and machining the soft magnetic material in a ring shape having an outer diameter of 18 mm and an inner diameter of 12 mm using a wire-electric discharge machine.

In the present invention, the spherical particles as a sintering material are obtained by melting an alloy having the given composition, and subjecting the molten alloy to a high-pressure-gas atomizing process (gas atomizing process). The amorphous soft magnetic alloy of the above composition obtained through the gas atomizing process has an excellent soft magnetism at room temperature and exhibits a high saturation magnetization of 1.3 to 1.4 T. Thus, the spherical particles are valuable as a material having excellent soft magnetic characteristics, and can be used for various purposes. A powder obtained through a gas atomizing process using the conventional alloy has a spherical or approximately spherical shape (see, for example, the Patent Publication 6), but not a complete spherical shape.

The composition of the amorphous soft magnetic alloy of the present invention has a sufficient glass forming ability. Thus, an approximately complete spherical fine particle having excellent fluidity can be prepared by a gas atomizing process. This makes it possible to obtain a high-density green compact more easily as compared to particles prepared by crushing a foil strip, and the green compact can be sintered to obtain a sintered body close to a true density.

As one example of a production method for the above amorphous soft magnetic alloy fine particle, a gas atomizing process will be described in more detail below. The gas atomizing process comprises melting the amorphous soft magnetic alloy having the above composition, atomizing the molten alloy in mist form by high-pressure inert gas within a chamber filled with inert gas, and quenching the atomized particles in an inert gas atmosphere within the chamber to produce an alloy powder.

FIG. 1 is a schematic sectional view showing one example of a gas atomizing apparatus suitably used in producing the alloy powder by the gas atomizing process. This gas atomizing apparatus primarily comprises a crucible 1, an inert gas sprayer 3, and a chamber 4.

The crucible 1 contains molten alloy 5. The crucible 1 is provided with a high-frequency heating coil 2 serving as heating means for heating the molten alloy 5 to keep it in a molten state. The molten alloy is dropped into the chamber 4 from a molten alloy nozzle 6 attached to a bottom portion of the crucible 1, or ejected into the chamber 4 from the molten alloy nozzle 6 by inert gas introduced in the crucible 1 under pressure.

The inert gas sprayer 3 is disposed under the crucible 1. The inert gas sprayer 3 has an inert-gas inlet passage 7 and a plurality of gas injection nozzles 8 located at the terminal end of the inert-gas inlet passage 7. The inert gas is pre-pressurized at about 2 to 15 MPa by pressurization means (not shown). The pressurized inert gas is introduced to the inert gas sprayer 3 through the inert-gas inlet passage 7, and injected from the gas injection nozzles 8 into the chamber 4 to form a plurality of gas streams g.

The inner space of the chamber 4 is filled with the same type of inert gas as that of the inert gas to be injected from the inert gas sprayer 3. The chamber 4 has an inner pressure kept at about 70 to 100 kPa, and an inner temperature kept at room temperature.

In a process for producing the alloy powder, the molten alloy 5 contained in the crucible 1 is firstly dropped or ejected from the molten alloy nozzles 6 into the chamber 4. Simultaneously, the pressurized inert gas is injected from the gas injection nozzles 8 of the inert gas sprayer 3. The injected inert gas is formed as gas streams g. Then, the gas streams g reach the dropped or ejected molten alloy, and collide with the molten alloy at an atomization point p. Thus, the molten alloy is rapidly solidified, and deposited on a bottom portion of the chamber 4 in the form of spherical particles primarily comprising an amorphous phase. In this way, an alloy powder consisting of a single phase of metallic glass can be obtained.

The above method makes it possible to prepare a spherical metallic glass alloy particle having a crystallization temperature (Tx) of about 700 to 800 K, a glass transition temperature (Tg) of about 730 to 750 K, and a liquidus temperature (Tl) of about 1220 to 1300 K each of which is greater than that of the conventional Fe-based glass alloy particle.

FIG. 2 shows an SEM (Scanning Electron Microscope) observation image of the obtained spherical particle. As seen in FIG. 2, the spherical particle has an approximately complete spherical shape and a particle size of about several μm to several ten μm. The particle size of the alloy powder can be controlled in the range of several μm to one hundred and several ten μm by adjusting the pressure of the inert gas to be injected, the speed of the molten alloy to be dropped or ejected, and/or the inner diameter of the molten metal nozzle 6. The spherical particle with an amorphous phase has a maximum particle size of about 53 to 125 μm.

If the particle size is excessively increased, the powder will have an elliptical shape, and a lower fluidity. If the particle size is excessively reduced, the powdered particles will have an increased specific surface. This is more likely to cause oxidation and deterioration in handling performance during the sintering process. Thus, the particle size suitable for the spark plasma sintering process is in the range of 30 to 125 μm, preferably in the range of 53 to 100 μm, which is a maximum range capable of obtaining a glass phase.

The production method for the Fe-based soft magnetic metallic glass sintered body of the present invention will be described in more detail below. FIG. 3 is a fragmentary sectional view showing one example of a spark plasma sintering apparatus suitable for use in producing the Fe-based soft magnetic metallic glass sintered body of the present invention. The illustrated spark plasma sintering apparatus primarily comprises a tubular die 9, a pair of upper and lower punches 10, 11 inserted into the tubular die 9, a punch electrode 12 supporting the lower punch 11 and serving as a first electrode for supplying the after-mentioned pulsed current, a punch electrode 13 pressing the upper punch 10 downward and serving as a second electrode for supplying the pulsed current, a thermocouple 15 for measuring a temperature of a sintering material 14 sandwiched between the upper and lower punches 10, 11.

In a process for producing the Fe-based soft magnetic metallic glass sintered body using the above spark plasma sintering apparatus, the plurality of spherical fine particles are firstly prepared. Then, a space between the upper and lower punches 10, 11 of the spark plasma sintering apparatus in FIG. 3 is filled with the spherical fine particles 14, and evacuated. Further, a compression pressure P is applied downward/upward from the upper and lower punches 10, 11 to the spherical fine particles 14, while applying to the spherical fine particles 14 a pulsed current I having a cycle, for example, where a current is supplied for 12 pulses and then interrupted for 2 pulses, as shown in FIG. 4, so as to form a sintered body. The spark plasma sintering process can strictly control a temperature of the spherical fine particles 14 in FIG. 3 according to the current to be supplied thereto, with a far higher degree of accuracy than that in heating using a heater. This makes it possible to perform the sintering under approximately optimal conditions just as being designed in advance.

In the present invention, it is required to set the sintering temperature at 573 K or more so as to solidify/form a powder alloy. The spherical fine particles having a wide temperature interval of the supercooled liquid region ($\Delta Tx = Tx - Tg$) can be sintered under compression pressure at the sintering temperature of 573 K or more to obtain a high-density sintered body.

In this case, if the sintering temperature is close to the crystallization temperature (Tx), the soft magnetic characteristics are likely to be deteriorated due to magnetic anisotropy caused by initiation of crystal nucleation (disorganization of a short-range structure) and/or initiation of crystal precipitation. Thus, an upper-limit sintering temperature (T) in the present invention is set in a range satisfying a relationship of $T \leqq Tx$, wherein Tx is a crystallization temperature. Further, if the solidification/formation is performed by utilizing a phenomenon that an amorphous alloy is soften at the glass transition temperature (Tg), a highly-densified powder alloy can be advantageously obtained.

In the present invention, a temperature rising or heating rate during the sintering is set at 40 K/min or more, because an excessively slow heating rate causes the formation of a crystal phase. Further, a compression pressure during the sintering is set at 200 MPa or more, preferably 300 MPa or more, because an excessively low compression pressure precludes the formation of a high-density sintered body. Additionally, while an adequate cooling rate is determined by the alloy composition, the size and shape of associated production means and an intended product, it may be typically set in the range of about 1 to $10^2$ K/min, only as a guide.

In addition, an obtained sintered body may be subjected to a heat treatment in vacuum for about 30 min to provide enhanced magnetic characteristics. This heat treatment may be performed at a temperature which is equal to or greater than the Curie temperature, and equal to or less than a temperature inducing the crystal precipitation which causes deterioration in magnetic characteristics. Specifically, the heat treatment temperature is set in the range of 573 to 725 K, preferably in the range of 573 to 673 K.

The sintered body obtained in this way has the same composition as that of the Fe-based soft magnetic metallic glass alloy used as a raw powder. Thus, the sintered body has excellent soft magnetic characteristics at room temperature. In particular, the sintered body exhibits a high specific resistance value of 1.6 μΩm or more. Therefore, as a material having excellent soft magnetic characteristics, this sintered body can be widely applied to various magnetic components, such as a magnetic head core, a transformer core, or a pulse motor core, and allows these magnetic components to have enhanced characteristics as compared to conventional components.

While the above description has been made in connection with the method of subjecting the raw powder of Fe-based soft magnetic metallic glass alloy to a spark plasma sintering process to obtain the sintered body, the present invention is not limited to the spark plasma sintering process. For example, the bulk Fe-based sintered alloy soft magnetic material of metallic glass may be obtained by sintering the raw powder under compression pressure through any other suitable process, such as an extrusion process.

BEST MODE FOR CARRYING OUT THE INVENTION

Example

Preparation of Spherical Alloy Material

Each of Fe, Ga, Fe—C alloy, Fe—P alloy, B and Si as raw materials was weighted on a scale to be set at a given amount. These raw materials were molten in an Ar atmosphere under reduced pressure by use of a high-frequency induction heating furnace, to form plural types of alloy ingots. Each of the ingots was put in a crucible to form a molten alloy having a given composition. Then, the molten alloy was dropped from a molten alloy nozzle having a hole diameter of 0.8 mm, and subjected to a gas atomizing process using a gas injection nozzle having an injection pressure set at 9.8 MPa, to prepare a spherical alloy powder.

The obtained alloy powder was sorted by 56 μm, 75 μm, 100 μm, 125 μm and greater than 125 μm, using a sieve. Each of the alloy powders was subjected to an X-ray diffraction analysis and a differential scanning calorimetry (DSC) to determine whether the alloy powder is crystallized. A maximum particle size in each of the alloy powders having an amorphous phase is shown in Table 1. As shown in Table 1, the maximum particle size in each of the alloy powders having an amorphous phase is in the range of 53 to 125 μm. Thus, the alloy powders having a particle size of 53 to 125 μm were selected and used as a row powder in a subsequent sintering process.

Table 1 shows the composition and particle size of each soft magnetic metallic glass alloy particle obtained through the above gas atomizing process. In Particle Nos. 7 to 9, a particle primarily comprising an amorphous phase could not be prepared due to crystal precipitation.

TABLE 1

| Particle No. | Alloy Composition | Maximum particle size with amorphous phase (μm) | Tg (K) | Tx (K) | Tg/Tl |
|---|---|---|---|---|---|
| 1 | $Fe_{75}Ga_5P_{10}C_4B_4Si_2$ | 100 | 745 | 780 | 0.593 |
| 2 | $Fe_{78}Ga_2P_{10}C_4B_4Si_2$ | 100 | 733 | 775 | 0.595 |
| 3 | $Fe_{77}Ga_3P_{9.5}C_4B_4Si_{2.5}$ | 125 | 750 | 798 | 0.605 |
| 4 | $Fe_{78}Ga_2P_{9.5}C_4B_4Si_{2.5}$ | 100 | 735 | 775 | 0.598 |
| 5 | $Fe_{76}Ga_4P_{9.5}C_4B_4Si_{2.5}$ | 100 | 745 | 788 | 0.593 |
| 6 | $Fe_{76}Ga_4P_9C_6B_4Si_3$ | 75 | 750 | 790 | 0.590 |
| 7 | $Fe_{67}Ga_{13}P_{9.5}C_4B_4Si_{2.5}$ | Unable to prepare | 715 | 745 | 0.565 |
| 8 | $Fe_{71}Ga_3P_{15.5}C_4B_4Si_{2.5}$ | Unable to prepare | 740 | 780 | 0.582 |
| 9 | $Fe_{69}Ga_3P_{10}C_4B_4Si_{10}$ | Unable to prepare | 720 | 740 | 0.566 |

Inventive Example 1

Figure 5:
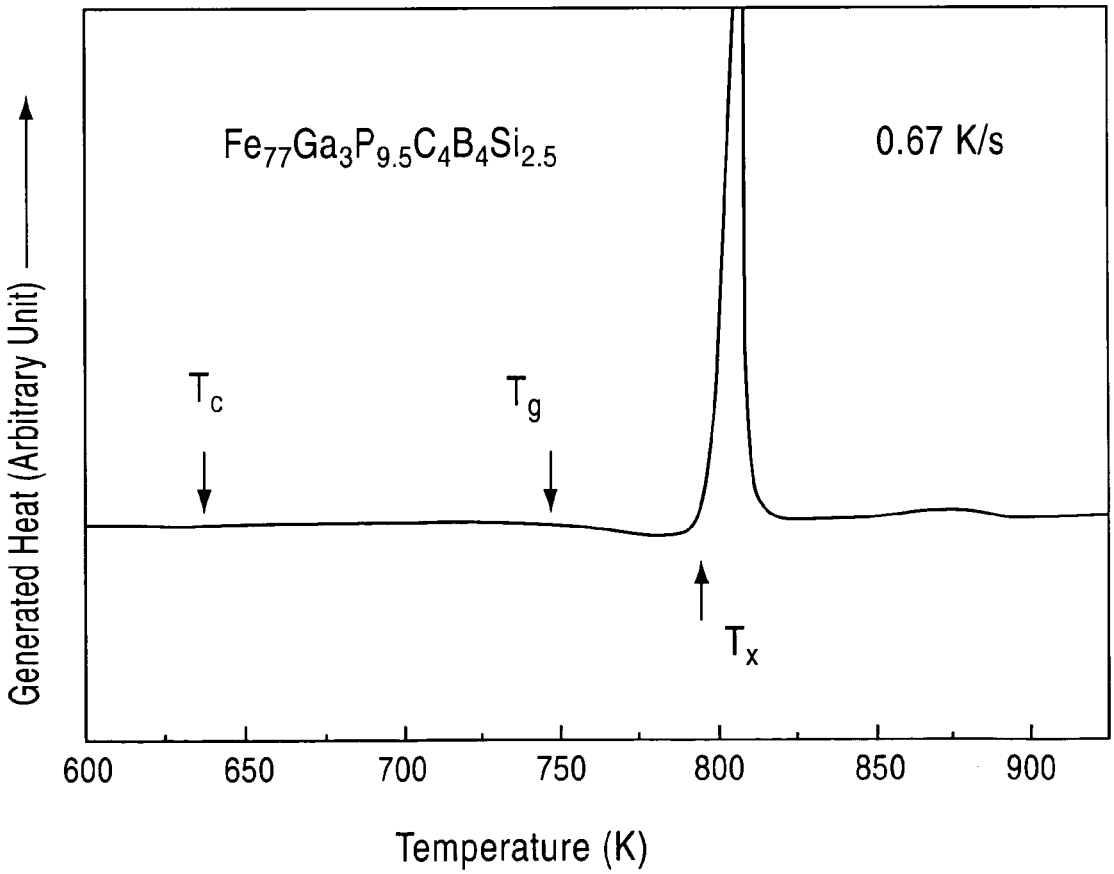
FIG. 5 is a graph showing a DSC curve of a raw alloy particle in Inventive Example 1.

The alloy particles having a composition of $Fe_{77}Ga_3P_{9.5}C_4B_4Si_{2.5}$ of Particle No. 3 in Table 1 were used as a sintering material. FIG. 5 shows a DSC (Differential Scanning Calorimetry) curve of the alloy particle. Based on the DSC curve in FIG. 5, Tx, Tg and ΔTx of the raw alloy particle are determined to be Tx=800 K, Tg=750 K and ΔTx=50 K.

Figure 1:
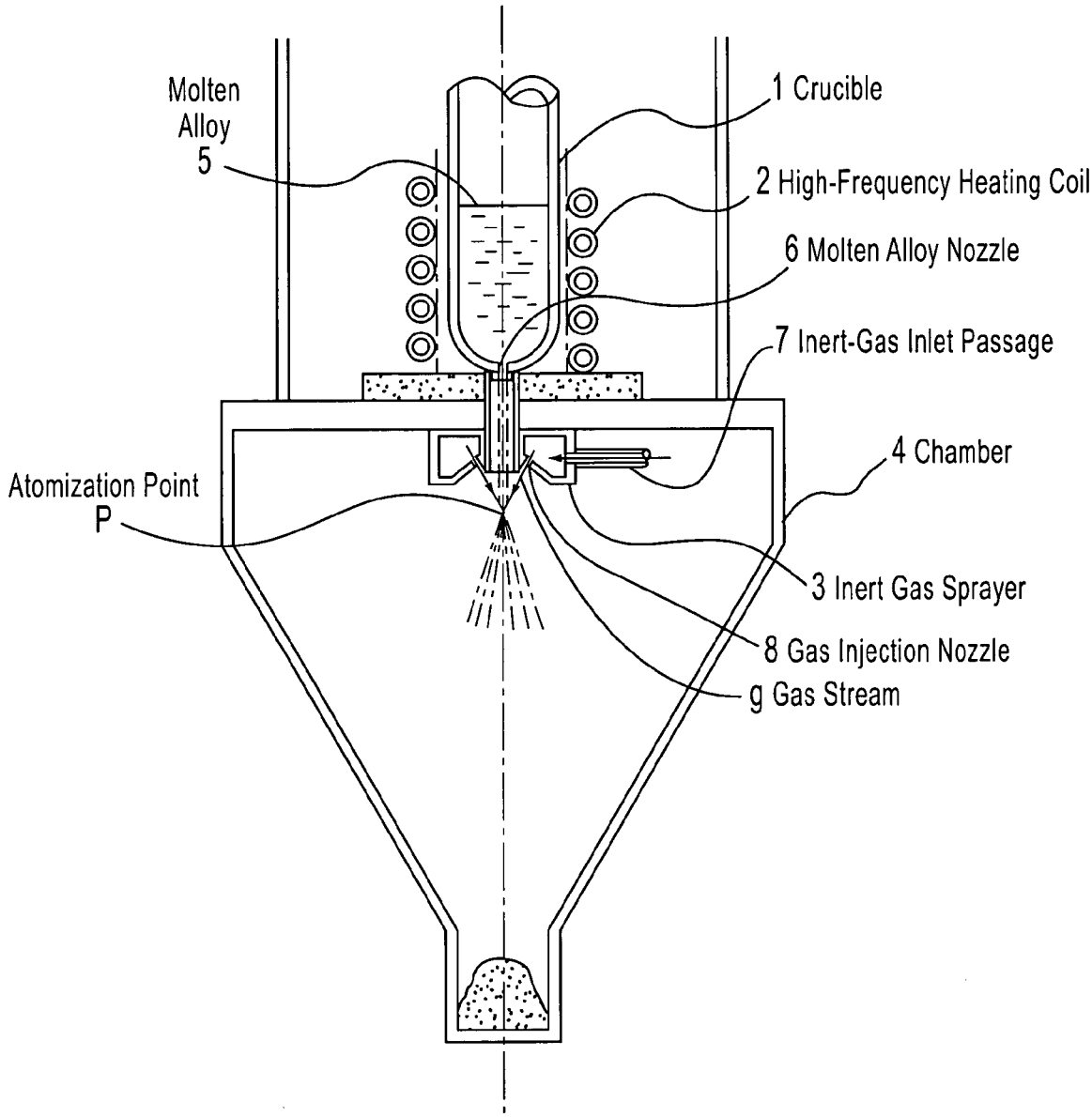
FIG. 1 is a schematic sectional view showing one example of a high-pressure-gas atomizing apparatus for use in producing metallic glass alloy particles to be used as a sintering material for a Fe-based sintered metal soft magnetic material of the present invention.
Figure 2:
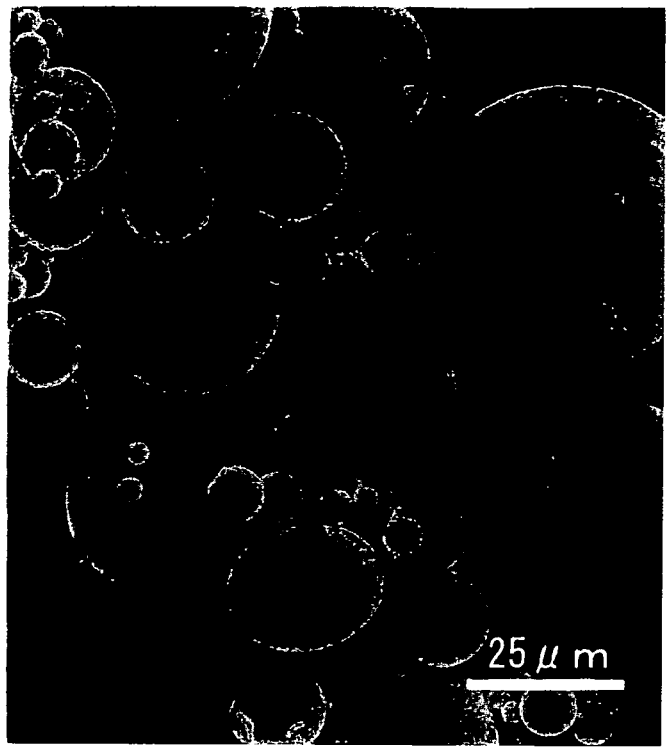
FIG. 2 is a photograph showing an SEM (Scanning Electron Microscope) observation image of one example of metallic glass alloy particles to be used as a sintering material for the Fe-based sintered metal soft magnetic material of the present invention.
Figure 3:
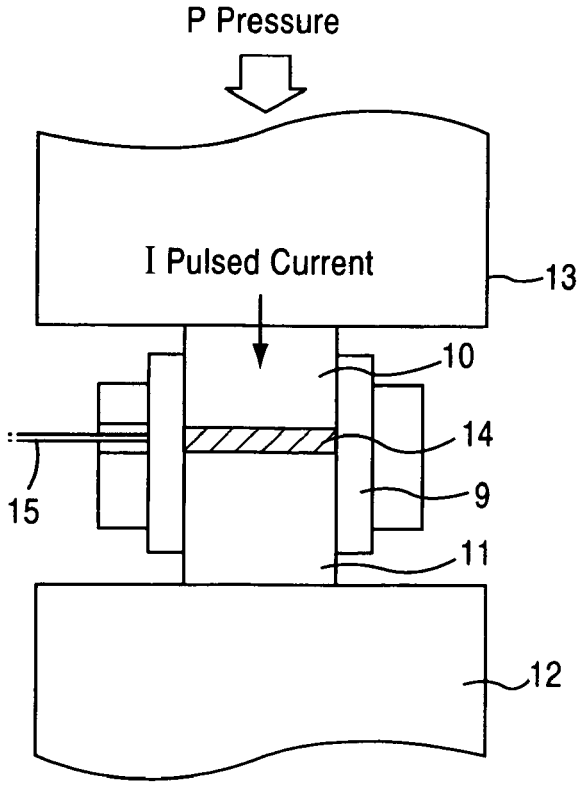
FIG. 3 is a fragmentary sectional view showing one example of a spark plasma sintering apparatus to be used for implementing a method of the present invention.
Figure 4:
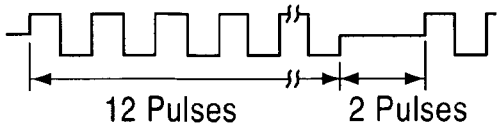
FIG. 4 is a waveform chart showing one example of a pulsed current to be applied to a sintering material in the spark plasma sintering apparatus illustrated in FIG. 3.

About 10 g of the sintering material consisting of particles having a sorted particle size of 45 μm or less was packed in the inner space of a WC dice using a hand press. Then, the sintering material was pressed by upper and lower punches 10, 11 in the inner space of the dice having an atmosphere of $3\times10^{-5}$ Torr, and simultaneously a pulsed current was applied from a current supply device to the sintering material to heat the sintering material. The pulse waveform of he pulsed current was designed to supply a current for 12 pulses and then interrupt the current for 2 pulses, as shown in FIG. 4. The sintering material or sample receiving a compression pressure of 300 MPa was heated from room temperature up to a sintering temperature of 723 K, and sintered at 723 K for about 5 min. A temperature rising or heating rate was set at 50 K/min. The sintering temperature to be monitored is a temperature of a thermocouple installed in a die because of the mechanism of the park plasma sintering apparatus. Thus, the monitored temperature is less than an actual temperature of the sintering or powder material, and the sintering temperature is an estimated value based on the monitored temperature.

Inventive Example 2

Except that a compression pressure was set at 200 MPa, a sintered body was produced under the same conditions as those in Inventive Example 1.

Comparative Example 1

Except that a compression pressure was set at 100 MPa, a sintered body was produced under the same conditions as those in Inventive Example 1.

Inventive Example 3

Except that the sintering material consisting of particles having a sorted particle size of 45 to 75 μm was used, a sintered body was produced under the same conditions as those in Inventive Example 1.

Inventive Example 4

Except that the sintering material consisting of particles having a sorted particle size of 75 to 125 μm was used, a sintered body was produced under the same conditions as those in Inventive Example 1.

Inventive Example 5

Except that the sintering material receiving a compression pressure of 600 MPa was sintered at each of three sintering temperatures of 723 K, 733K and 743K, three sintered bodies were produced under the same conditions as those in Inventive Example 1.

Figure 6:
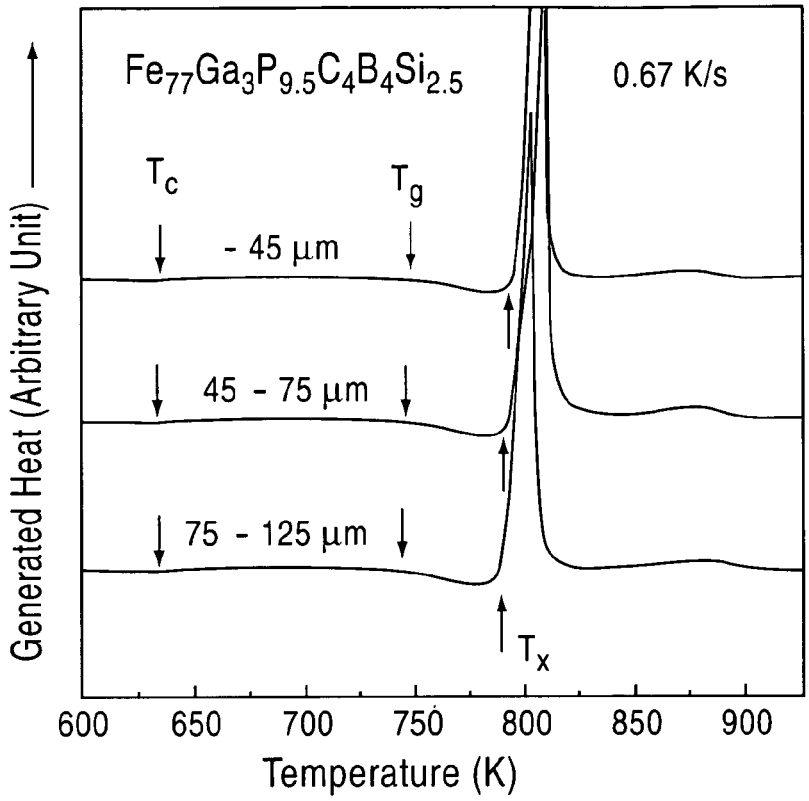
FIG. 6 is a graph showing a DSC curve of each sintered body in Inventive Examples 1, 3 and 4.

FIG. 6 shows a DSC curve of each sintered body obtained in Inventive Examples 1, 3 and 4. Based on the DSC curves in FIG. 6, Tx, Tg and ΔTx of the sintered bodies are determined to be Tx=800 K, Tg=750 K and ΔTx=50 K. As seen in the results of FIGS. 5 and 6, each value of Tx, Tg and ΔTx is the same in the raw alloy particle and the sintered body. In FIGS. 5 and 6, Tc is a Curie temperature.

Figure 7:
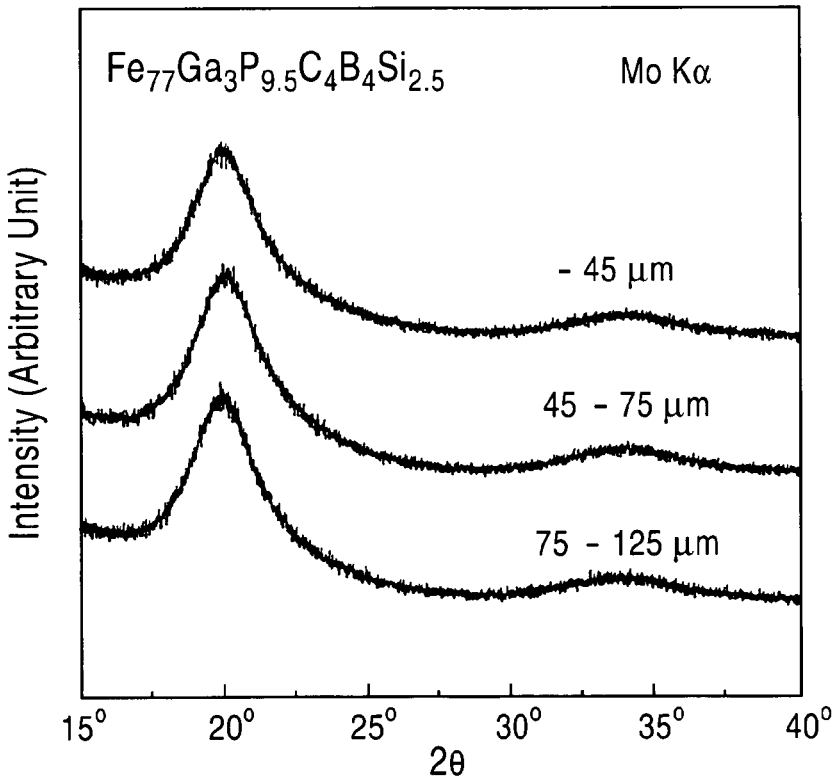
FIG. 7 is a graph showing an X-ray diffraction pattern of each sintered body in Inventive Examples 1, 3 and 4.

FIG. 7 shows the result of an X-ray diffraction analysis of each sintered material obtained in Inventive Examples 1, 3 and 4, in an as-sintered state. It is proven that each of the diffraction curves has a similar pattern irrespective of a particle size.

Figure 8:
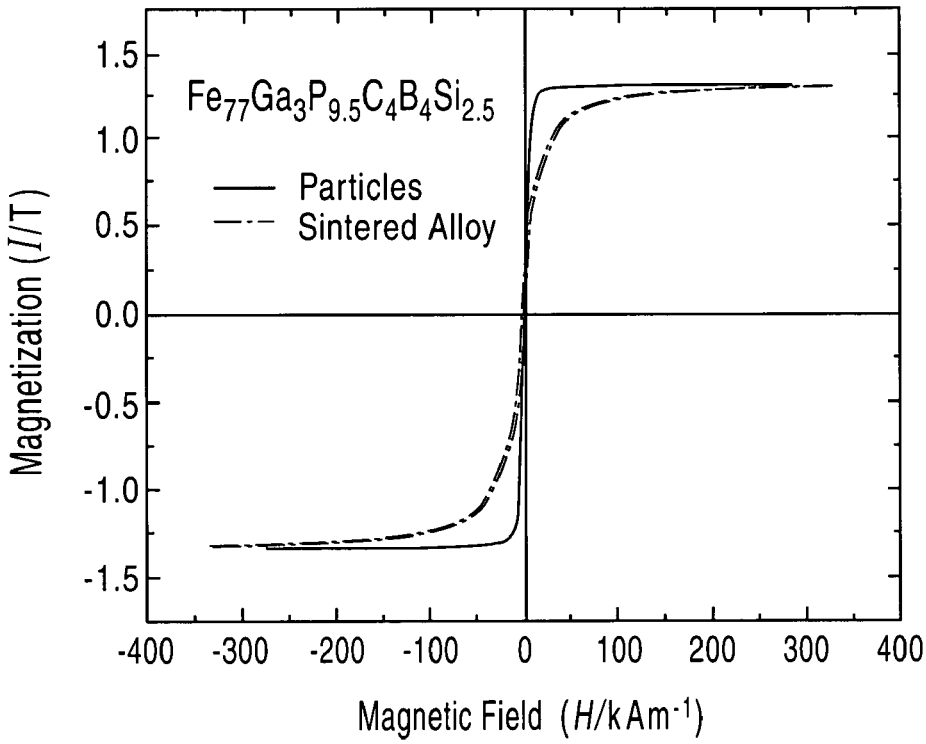
FIG. 8 is a graph showing a saturation magnetization characteristic of a sintered body obtained in Inventive Example 1 in comparison to that of raw particles.

FIG. 8 shows a saturation magnetization characteristic of the sintered body obtained in Inventive Example 1 in comparison to that of raw particles. As seen in FIG. 8, they have a soft magnetism at room temperature, and exhibit a high saturation magnetization of about 1.35 T.

Figure 9:
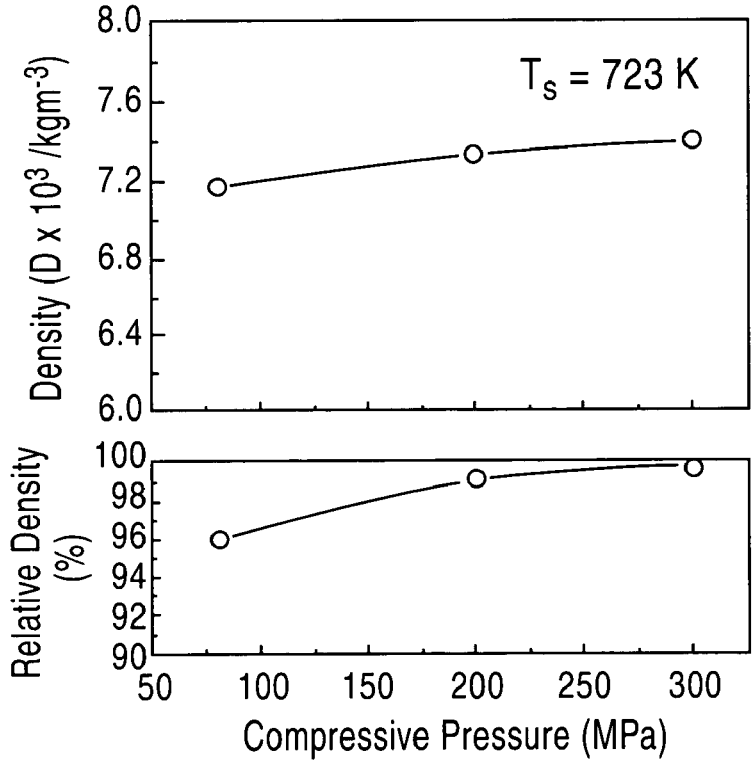
FIG. 9 is a graph showing a compression-pressure dependence during sintering of the density and relative density of each sintered body obtained in Inventive Examples 1 and 2 and Comparative Example 1.

FIG. 9 shows a relationship of a compression pressure, a density and a relative density of each sintered body obtained in Inventive Examples 1 and 2 and Comparative Example 1. As seen in FIG. 9, the density of the sintered body is increased along with increase in the compression pressure. FIG. 9 shows that a high-density sintered body having a relative density of 99.0% or more can be obtained when the sintering is performed under a compression pressure of 200 MPa, and a high-density sintered body having a relative density of 99.7% or more can be obtained when the sintering is performed under a compression pressure of 300 MPa.

Figure 10:
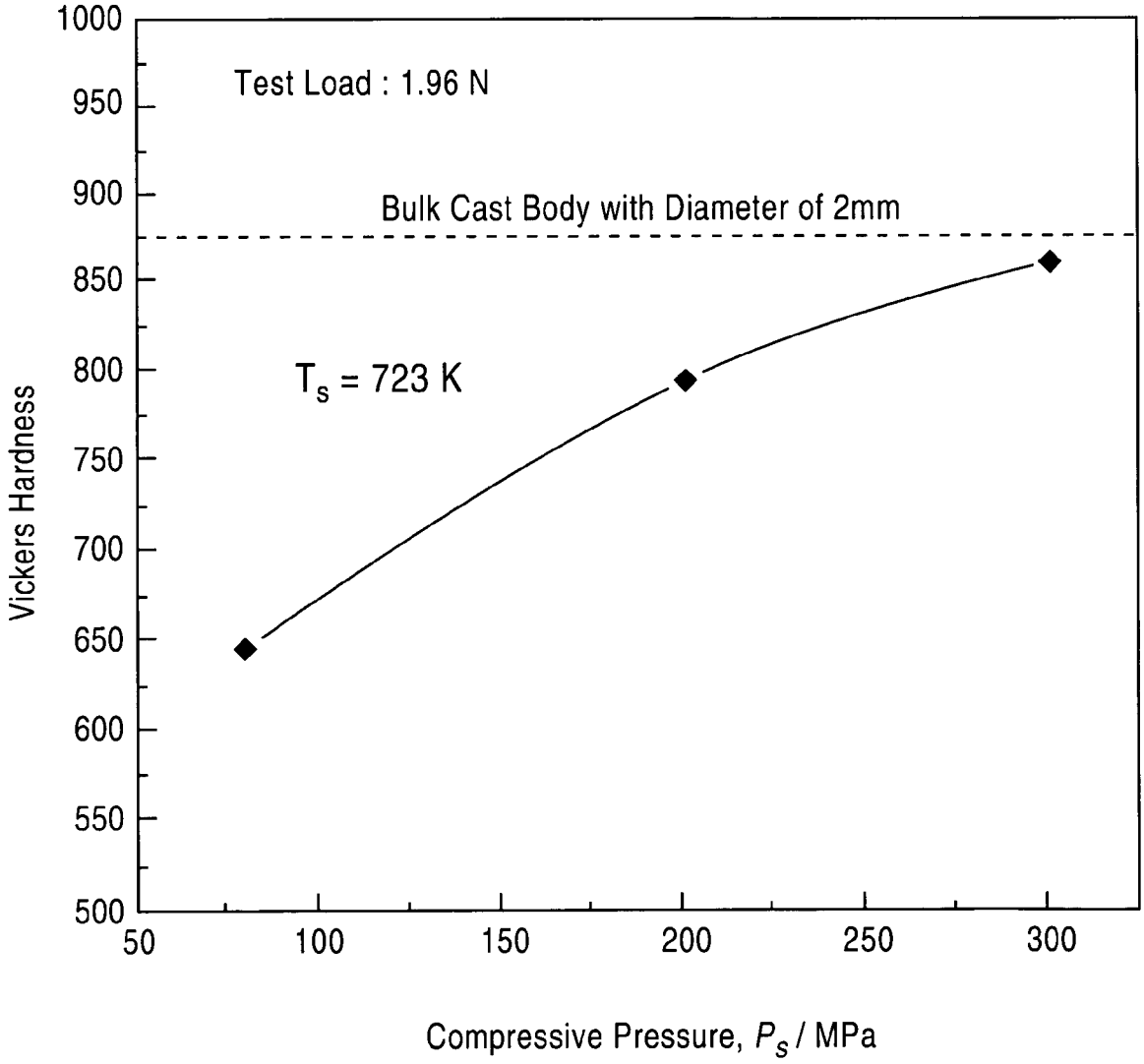
FIG. 10 is a graph showing a relationship between a compression pressure and a Vickers hardness of each sintered body obtained in Inventive Examples 1 and 2 and Comparative Example 1.

FIG. 10 shows a relationship between a compression pressure and a Vickers hardness of each sintered body obtained in Inventive Examples 1 and 2 and Comparative Example 1. As seen in FIG. 10, the bulk cast alloy having a diameter of 2 mm and the same composition has a Vickers hardness of about 875. The hardness of a sintered body is increased along with increase in the compression pressure, and comes close to the Vickers hardness of the bulk cast alloy.

Figure 11:
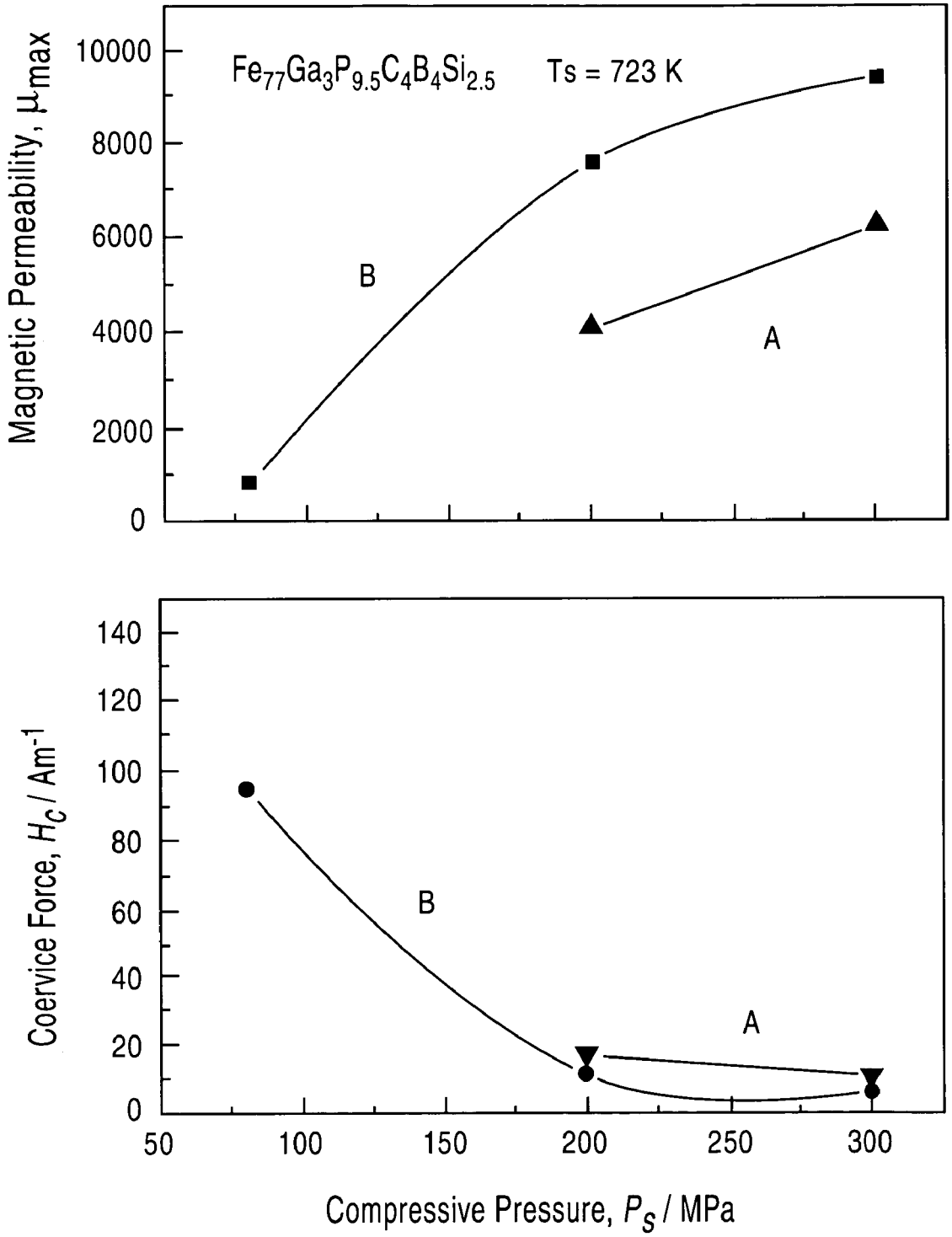
FIG. 11 is a graph showing a compression-pressure dependence of a magnetic permeability and a coercive force of each sintered body before and after a heat treatment, obtained in Inventive Examples 1 and 2 and Comparative Example 1.

FIG. 11 shows a relationship of a compression pressure during the sintering, a magnetic permeability (μ max) and a coercive force (Hc) of each sintered body before (curve A) and after (curve B) a heat treatment, obtained in Inventive Examples 1 and 2 and Comparative Example 1. Soft magnetic characteristics are also improved in conjunction with increase in the compression pressure. As seen in FIG. 11, the sintered body sintered under a compression pressure of 200 MPa exhibits a magnetic permeability (μ max) of about 3900 and a coercive force (Hc) of about 19 A/m, and the sintered body further subjected to the heat treatment exhibits a higher magnetic permeability (μ max) of about 7000 and a lower coercive force (Hc) of about 12 A/m. Further, the sintered body sintered under a compression pressure of 300 MPa exhibits a magnetic permeability (μ max) of about 6000 and a coercive force (Hc) of about 11 A/m, and the sintered body further subjected to the heat treatment exhibits a higher magnetic permeability (μ max) of about 9000 and a lower coercive force (Hc) of about 4 A/m.

Figure 12:
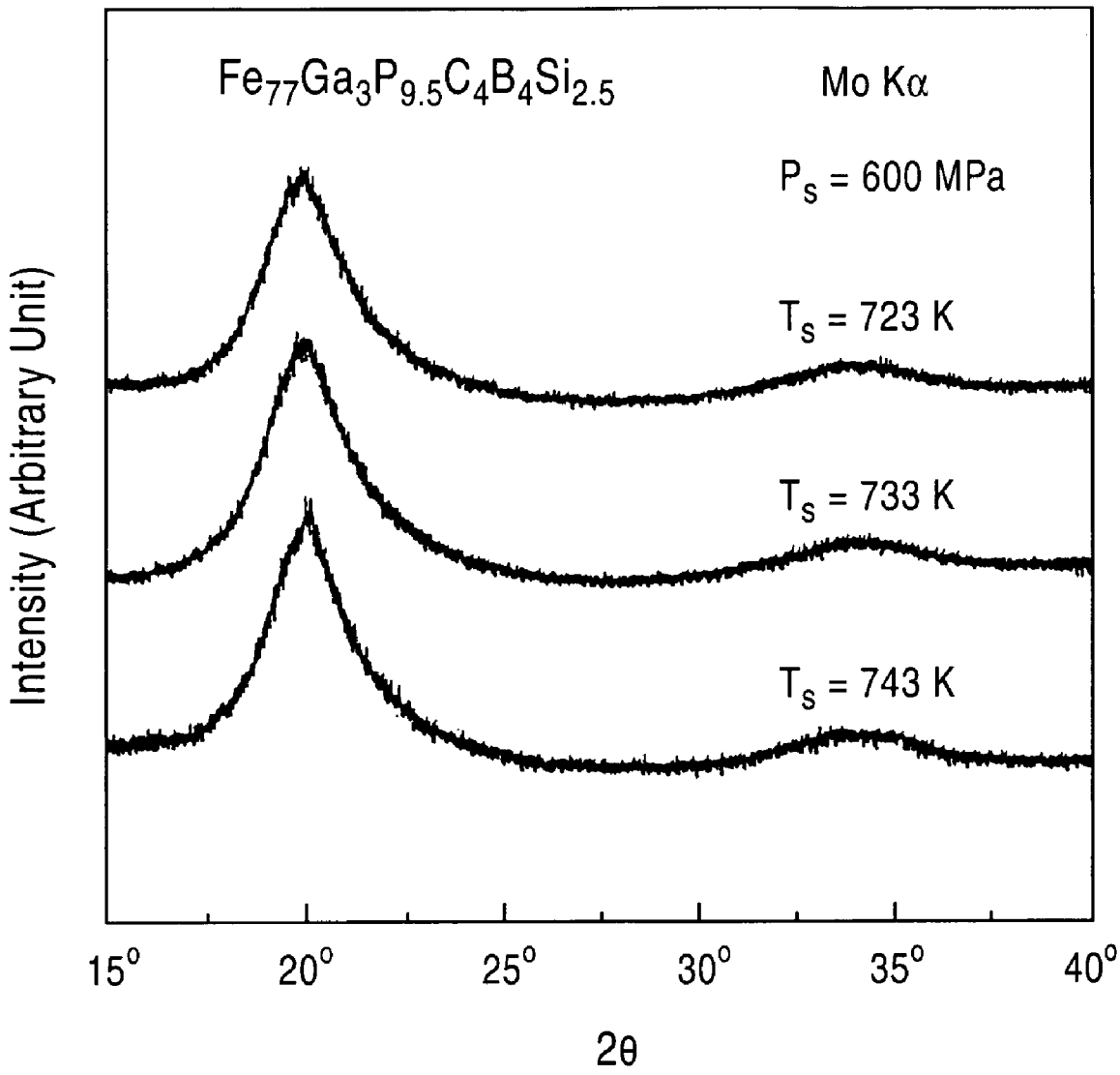
FIG. 12 is a graph showing an X-ray diffraction pattern of a sintered body obtained in Inventive Example 5.

FIG. 12 is a graph showing an X-ray diffraction pattern of the sintered body obtained in Inventive Example 5. As seen in FIG. 12, even after a compression pressure is set at 600 MPa which is greater than that in Inventive Example 1, and a sintering temperature is increased by 10 k and 20 k as compared to Inventive Example 1, the X-ray diffraction pattern is similar to that in Inventive Example 1.

INDUSTRIAL APPLICABILITY

As mentioned above, according to the present invention, metallic glass alloy particles having a relatively large particle size, an approximately complete spherical shape, and a high crystallization temperature (Tx) can be sintered at the crystallization temperature or less under a compression pressure of 200 MPa or more to provide a bulk Fe-based sintered metal soft magnetic material of metallic glass, which has a high density, a single phase structure of metallic glass in an as-sintered state, excellent soft magnetic characteristics applicable to a core of a magnetic head, a transformer or a motor, and a high specific resistance.

What is claimed is:

1. A sintered soft magnetic element, comprising: Fe-based sintered alloy soft magnetic material of metallic glass, the sintered soft magnetic element being prepared by sintering, in a temperature range of 573 K to the crystallization temperature (Tx), spherical particles of Fe-based metallic glass alloy prepared by an atomizing process, the spherical particles having a particle size of 30 to 125 μm; a composition consisting of, by atomic %, 0.5 to 10% of Ga, 7 to 15% of P, 3 to 7% of C, 3 to 7% of B and 1 to 7% of Si, with the remainder being Fe, the Fe-based metallic glass alloy having a crystallization temperature (Tx) of 770 to 800 K and a liquidus temperature (Tl) of 1220 to 1300 K, wherein the Fe-based sintered alloy soft magnetic material has metallic glass phase of high-density with a relative density of 99.0% or more, a magnetic permeability of 3900 (μmax) or more, a coercive force (Hc) of 19 (A/m) or less and a specific resistance of 1.6 μΩm or more in an as-sintered state, wherein the Fe-based sintered alloy soft magnetic material has a temperature interval of a supercooled liquid region (ΔTx) of 25 K or more, as expressed by a formula: ΔTx=Tx−Tg, wherein Tx is a crystallization temperature, and Tg is a glass transition temperature; and a reduced glass transition temperature of 0.59 or more, as expressed by a formula: Tg/Tl, wherein Tg is a glass transition temperature, and Tl is a liquidus temperature.

2. A sintered soft magnetic element as defined in claim 1 sintering is performed in a temperature range of 573 to 723 K, wherein the Fe-based sintered alloy soft magnetic material has a magnetic permeability of 7000 (μ max) or more and a coercive force (Hc) of 12 (A/m) or less.

3. A sintered soft magnetic element, comprising: sintered metallic glass particles of a composition consisting of, by atomic %, 0.5 to 10% of Ga, 7 to 15% of P, 3 to 7% of C, 3 to 7% of B and 1 to 7% of Si, with the remainder being Fe, said metallic glass particles having maximum particle size of 30 to 125 μm, wherein the Fe-based alloy soft magnetic material has metallic glass phase of high-density with a relative density of 99.0% or more, a magnetic permeability of 3900 (μmax) or more, a coercive force (Hc) of 19 (A/m) or less and a specific resistance of 1.6 μΩm or more in an as-sintered state, wherein the Fe-based alloy soft magnetic material has a temperature interval of a supercooled liquid region (ΔTx) of 25 K or more, as expressed by a formula: ΔTx=Tx−Tg, wherein Tx is a crystallization temperature, and Tg is a glass transition temperature; and a reduced glass transition temperature of 0.59 or more, as expressed by a formula: Tg/Tl, wherein Tg is a glass transition temperature, and Tl is a liquidus temperature.

4. A sintered soft magnetic element as defined in claim 1, wherein the Fe-based sintered alloy soft magnetic material has a magnetic permeability of 7000 (μ max) or more and a coercive force (Hc) of 12 (A/m) or less.

* * * * *

UNITED STATES PATENT AND TRADEMARK OFFICE

CERTIFICATE OF CORRECTION

PATENT NO. : 7,622,011 B2
APPLICATION NO. : 10/540527
DATED : November 24, 2009
INVENTOR(S) : Inoue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 895 days.

Signed and Sealed this

Twenty-sixth Day of October, 2010

David J. Kappos

David J. Kappos
*Director of the United States Patent and Trademark Office*